United States Patent [19]

Snider

[11] Patent Number: 4,741,243

[45] Date of Patent: May 3, 1988

[54] LINE LAUNCHER

[76] Inventor: Billy G. Snider, 10334 Dar La., Goodrich, Mich. 48438

[21] Appl. No.: 30,086

[22] Filed: Mar. 26, 1987

[51] Int. Cl.[4] ..... F42B 13/56

[52] U.S. Cl. ..... 89/1.34; 102/504

[58] Field of Search ..... 89/1.34, 1.1; 102/504; 42/105; 43/17.5, 17.6

[56] References Cited

U.S. PATENT DOCUMENTS

| | | | |
|---|---|---|---|
| 229,058 | 6/1880 | Spencer | 89/1.34 |
| 932,270 | 8/1909 | Goodwin | 89/1.34 X |
| 1,072,968 | 9/1913 | McCreary | 89/1.34 |
| 1,072,969 | 9/1913 | McCreary | 102/504 |
| 1,322,601 | 11/1919 | Newlander | 89/1.34 X |
| 1,418,964 | 6/1922 | Norman | 89/1.34 |
| 2,373,364 | 4/1945 | Wellcome | 102/504 |
| 3,505,926 | 4/1970 | Johnson | 89/1.34 |
| 3,583,087 | 6/1971 | Huebner | 89/1.34 |
| 3,780,662 | 12/1973 | Sorenson | 102/504 |
| 3,863,380 | 2/1975 | Purlia | 43/17.6 |
| 3,918,190 | 11/1975 | Hornbeck | 43/17.6 X |
| 4,326,657 | 4/1982 | Arpin et al. | 102/504 X |
| 4,649,660 | 3/1987 | Kurka et al. | 43/17.5 |
| 4,653,379 | 3/1987 | Barret et al. | 89/1.34 |
| 4,656,945 | 4/1987 | Stancil | 102/504 X |

FOREIGN PATENT DOCUMENTS

| | | | |
|---|---|---|---|
| 2753494 | 6/1979 | Fed. Rep. of Germany | 102/504 |
| 2757250 | 6/1979 | Fed. Rep. of Germany | 102/504 |

*Primary Examiner*—David H. Brown

*Attorney, Agent, or Firm*—Arnold S. Weintraub

[57] ABSTRACT

A line launcher for launching a line spool provided with a length of line thereon toward a devised target comprising: a projectile or propelling means, generally a blank cartridge chamberable into a conventional marine flare pistol; a tubular housing with the line spool container therein; a lead ballasted end cap; a bored fore end cap; and an air spaced within the housing. One end of the line projects from the housing through the bored end cap and may be secure to a heavier line. Upon launching the device by discharge of the pistol, the line continuously uncoils from the line spool until it reaches the point of impact. A secure line is then provided between the point of impact and the securing point.

6 Claims, 2 Drawing Sheets

LINE LAUNCHER

BACKGROUND OF THE INVENTION

1. Field of the Invention

This invention relates to the field of devices for launching a line over, for example, a body of water, and more particularly to such devices which launch a line spool provided with a length of lightweight line having a free end secured to a securing means, wherein the lightweight line uncoils during the trajectory of the line spool to provide a secure line between the point of impact of the spool end and the point of attachment of the lightweight line.

2. Description of the Prior Art

The usefulness of a device for launching a line over an expanse of space in situations where there is an immediate need for the line has long been known. Such line launching devices have commonly been used in rescue situations which occur both on land and at sea. For example, such a device might be used in a case where a boat has capsized and the rescue vessel must reach the victims with a rescue line as soon as possible. Another common emergency use of such a device is to launch a line to victims of a building fire. Of course, such devices also find equal utility in non-emergency situations, such as when one vessel wishes to launch a low line to a second vessel.

Most commonly, such devices employ a charged, blank cartridge to provide the inpetus to launch the line. Typically, as may be seen from U.S. Pat. Nos. 229,058; 932,270; 1,322,601; 1,418,964; 3,505,926; and 3,583,087, a projectile is provided which is adapted to be chambered into a gun. The projectile contains a suitable means of propulsion, such a charge of black powder, contained therein. One end of a line is attached to the projectile. The remainder of the line is either coiled and kept in a container such as a box, or wound around a spool which is secured, for example, to the barrel of the gun. To use these prior art devices, the gun is aimed somewhat over the target and fired. The projectile is then forcibly expelled from the gun in the direction of fire thereof. As the pojectile moves through the air, the coiled or wound-up line will uncoil or unwind. When the projectile reaches point of impact, it will provide a secure line between the point of impact and the launching party.

The spool, being a separate piece of the system, may require considerable care when assembled, positioned and aligned with the rest of the device for the successful operation thereof. The handling of a separate spool demands the utmost care to prevent the line from fouling or tangling, as does the storage of such a spool. This amount of care could prove time consuming at the least and possibly render the device ineffective if not executed in the proper manner.

Additionally, the accuracy of launch of such a line launching device is a very important factor in its ultimate effectiveness. The prior art devices may be awkward, unbalanced or difficult to aim, because of the presence of the separate spool. Also, if the initial usage failed because of the said disadvantages or miscalculation by the user, the subsequent attempt would necessarily involve a reloading procedure. Prior art reloading procedures would be time consuming and could contribute to user error in an emergency situation.

If the prior art devices are to be employed to tow a secondary line, other problems may become apparent. There would be need to be provisions to have access to the line end, which is not fastened to the projectile, for the purpose of securing the secondary line prior to the discharge of the projectile. If the line end is made accessible, it or the secondary line connection may lie in such a position as to adversely affect the accelerating projectile or the uncoiling spool.

It would be desirable to provide a cartridge fired line launcher which minimizes or eliminates user operation errors.

It would also be desirable to provide a cartridge fired lined launcher which minimizes or eliminates the problem of the fouling and the tangling of the line caused by improper unwinding or coiling thereof.

It would also be desirable to incorporate the above-listed features in a unitized device which may be chambered into a marine flare pistol of ordinary design.

SUMMARY OF THE INVENTION

The line launcher of the instant invention is designed to overcome all of the problems encountered with prior art devices of this type. The device disclosed and claimed herein is adapted to be chambered into a marine flare pistol of conventional design. The line launcher comprises a line spool with a length of line center wound therearound in such a manner so as to permit ready uncoiling off therefrom. The length of line has a free end which is uncoiled from the center of the line spool and is provided with a fastening means attached thereto. Typically, the fastening means will comprise a stainless steel ring, which may be split. The line launcher further comprises a housing to contain the line spool and line wound therearound and a projectile or propelling means mounted to the housing. Typically, the projectile propelling means will comprise a blank cartridge with a charge contained therein, said blank cartridge being of a suitable size to chamber into the flare pistol. The two most common type of flare pistols in use today are the 25 millimeter and the 12 gauge. Hence the cartridge will most typically be a 25 millimeter cartridge or a 12 gauge cartridge, but the invention is not limited to cartridge of these two sizes.

The line launcher is first chambered into the marine flare pistol. The free end of the line is attached to a securing means such as a secondary, normally, heavier line. The line launcher is then launched in the desired direction by discharging the pistol to cause the housing to be ejected therefrom. As the housing flies towards its target, the line will uncoil from the line spool during the trajectory thereof. The line will continue to uncoil until the line spool and housing reach the point of impact. The point of impact and the point of attachment to the securing means will provide a secure line between the party firing the pistol and the party needing the line. The party in need of the line can pick-up the uncoiled line launcher, reel in the unwound line until the point of attachment to the heavier line is reached. At that point, the heavy line may be attached to a person, vessel, etc., as desired, and the heavy, secured, line may be used for its intended purpose, i.e., hauling in a person, pulling in a boat, sending a rescue article such as a ladder or a breeches buoy, etc.

In one embodiment of the instant invention, the housing which contains the line spool and line is tubular in shape and has fore and aft ends. An aft end cap is mounted on the aft end of the housing. The projectile propelling means, usually a blank cartridge, is attached to the aft end of the housing behind the aft end cap. The line spool is disposed within the housing adjacent the aft end. The space between the aft end cap and the fore end of the housing will form an air chamber after the line has been expelled by launching. The aft end cap mounted to the housing is provided with a lead ballast mounted on an interior face thereof. This ballast serves four purposes: (1) it provides flight stability for the housing since the dominant weight distribution to the aft end of the discharged housing provided by the ballast causes the housing to fly with a slow fore to aft rotation without impeding the line expellment; (2) the weight of the ballast contributes to a longer distance of flight; (3) the ballast is used to secure one end of the line of spool and (4) the combination of the ballast and the air space will permit the ejected housing to float in a fore end up orientation while in the water. This fore end up orientation is necessary to insure the line exits at a point above the water line. Also, the buoyancy feature will greatly assist the retrieval of the housing and line attached thereto by the party toward which they have been launched.

In another embodiment, the fore end of the tubular housing has a fore end cap mounted therein. The fore end cap has a bore therethrough. A hollow nose tubing is mounted in the fore of the fore end cap and projects therefrom. A hollow, bored nose cap is mounted over the projecting end of the nose tubing. The nose tubing will typically have a smaller diameter than the diameter of the tubular housing. A free end of the line uncoiled from the center of the line spool is sequentially threaded through the bore of the fore end cap, the hollow nose tubing and the bore of the nose cap to project therefrom.

When the line spool provided in this embodiment is launched from the marine flare pistol, the uncoiling line spool will be securely contained within the housing and the two end caps. Since the free end of the line has been threaded through the constricted passage formed by the hollow nose tubing and the nose cap, the uncoiling line is even less likely to tangle or foul during uncoiling.

Another preferred embodiment of the instant invention finds particular utility for night operations or in other situations of reduced daylight. A capsule capable of luminescence is mounted to the side wall of the nose tubing. The capsule must first be bent, shaken up, and then attached to the clear nose tubing before the line launcher is loaded into the flare pistol. Luminescent capsules of this type are sold under the trade name of Cyalume®, which are available from the American Cyanimid Company. The bright green fluorescent glow of this capsule has two purposes. A primary purpose is to aid the targeted person in locating the line in a near miss situation. The line launcher will float nose up, emitting a bright green glow. A secondary purpose is to assist the person launching the line to see the path of the flight thereof. If the shot has been badly placed, the shooter will be able to reload, compensate for the error, and shoot again.

BRIEF DESCRIPTION OF THE DRAWING

The various features, advantages and other uses of the present invention will become more apparent by referring to the following detailed description and drawing in which.

DESCRIPTION OF THE PREFERRED EMBODIMENTS

Figure 1:
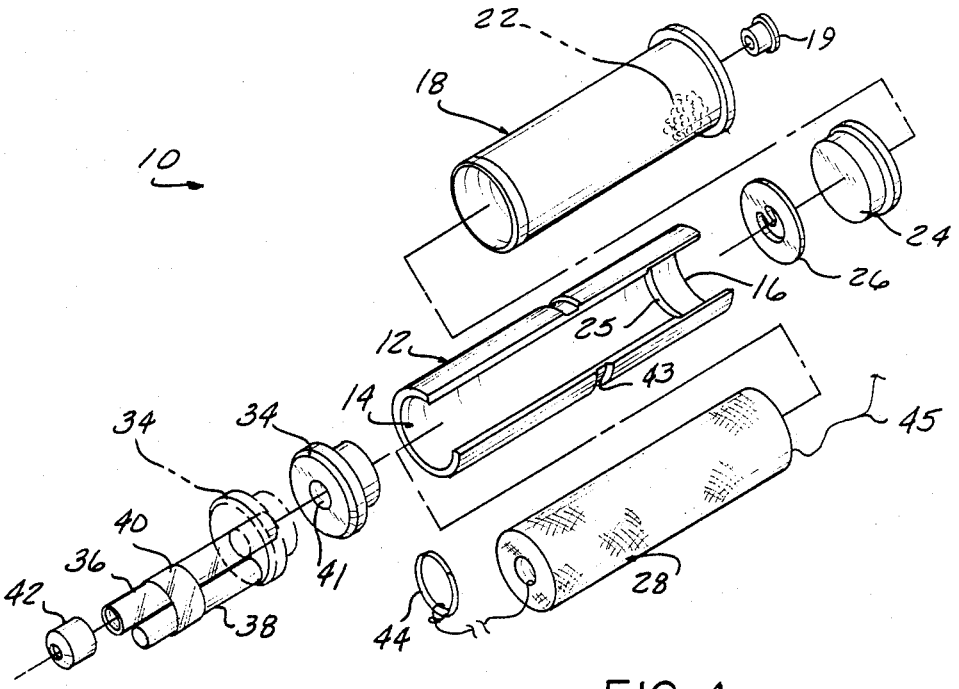
FIG. 1 ia an exploded view of a line launcher constructed in accordance with the teaching of the present invention and illustrating the relationship of the parts thereof and showing a line projecting therefrom.

Throughout the following description and drawing, identical reference numbers are used to refer to the same component shown in multiple figures of the drawing.

Figure 2:
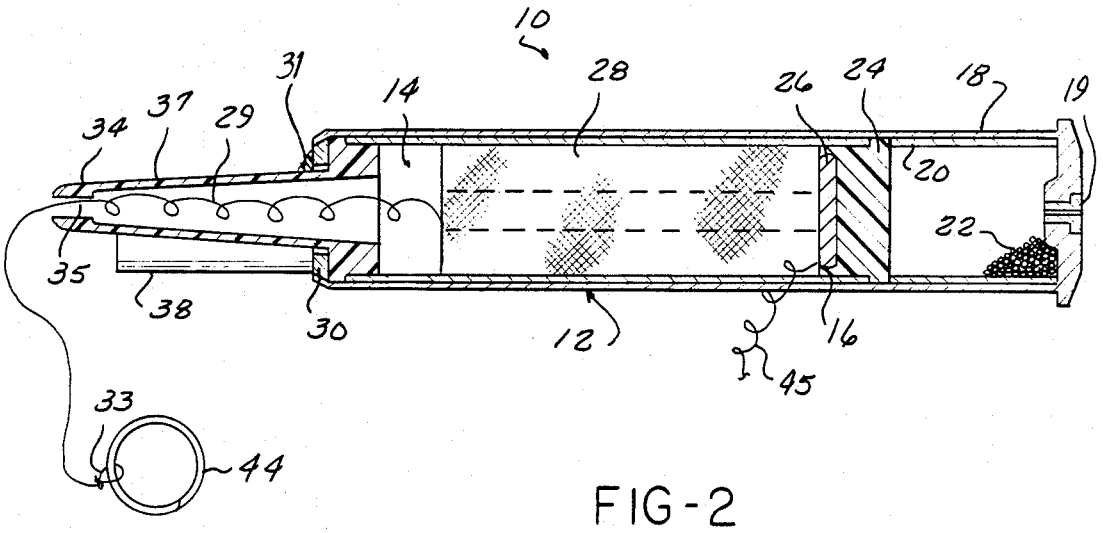
FIG. 2 is an longitudinal-sectional view of one embodiment of the line launcher of the instant invention.

Referring now to the drawings and to FIG. 2, there is depicted one embodiment of the line launcher of the instant invention shown in longitudinal cross section. The line launcher 10 is comprised of a tubular housing 12 which is typically formed of thin walled aluminum tubing. The tubular housing 12 has a fore end 14 and an aft end 16. An aft end cap 24 is mounted adjacent the aft end 16 of the tubular housing 12. Mounted behind the aft end cap is a cardboard spacer tube 20 which forms a combustion chamber. Shell casing 18 contains the assembled components. While the shell casing 18 depicted in FIG. 1 is a 25 millimeter shell casing of the type used for parachute flares, it is to be understood that the invention is not limited to shell casings of this size but may be used with any sized cartridge adapted to be chambered into a marine flare pistol. A shell primer 19 is formed on a back wall of the shell casing 18. Contained inside shell casing 18 is a charge 22 of black powder, typically 19 grains.

Contained within the tubular housing 12 is a line spool 28. This line spool 28 is comprised of a length of line 29 which is center wound in such a manner as to permit ready uncoiling therefrom. Typically, a line 29 will comprise a small diameter line of high strength to weight ratio. The gauge and length of the line 29 is such as to be containable in the tubular housing 12. At least 200 feet of the line will be light enough to be launchable with the 25 millimeter projectile propelling means. The length of line 29 contained in the 12 gauge version is at least 120 feet. One end of line 29 is left free to form free end 33. The other end 45 is attached to a ballast 26, shown in FIG. 1.

Mounted into the fore end 14 of tubular housing 12 is fore end cap 34. Fore end cap 34 has formed therethrough a bore 35. Typically, both fore end cap 34 and aft end cap 24 are formed of clear plastic by injection molding. Waterproof glue is used to form a watertight seal between tubular housing 12 and both fore end cap 34 and aft end cap 24. Fore end cap 34 includes a portion of reduced diameter 37. The purpose of the portion of reduced diameter 37 is to prevent tangling or fouling of line 29 as it uncoils from line spool 28 during the trajectory of the line launcher.

The free end 33 of line 29 is threaded through bore 35 formed in the fore end cap 34 and projects therefrom. Attached to free end 33 is an attaching means 44, which typically comprises a split stainless steel ring. A heavier line (not shown) may be attached to attachment means 44. A cardboard retaining ring 30 and rubber sealant compound 31 are used to contain the assembled housing components into the shell casing 18.

The embodiment of the line launcher shown in exploded view in FIG. 1 is similar in design to the embodiment depicted in FIG. 2. In FIG. 1, a lead ballast 26 is depicted which is disposed between shoulder 25 and aft end cap 24. Fore end cap 34 further comprises nose tubing 36 and nose cap 42. The outside diameter of nose tubing 36 is such that nose tubing 36 may be glued into bore 41 of end cap 34, with one end of nose tubing 36 projecting therefrom. Nose cap 42, which is also bored, is also mounted over the projecting end of nose tubing 36. In the embodiment depicted in FIG. 1, the free end 33 of line 29 will be sequentially threaded through bore 41 of end cap 34, nose tubing 36, and nose cap 42 to project therefrom. The other end 45 of line 29 is attached to ballast 26 by, for example, typing. The attachment of the other end 45 is this manner will allow for the location and retrieval of line 29 and housing 12 after launching. In the embodiment in FIG. 1, a Cyalume® capsule 38 is secured by any suitable means, such as by taping on the side of nose tubing 36 with transparent tape 40. Additionally, the shell casing 18 in the embodiment in FIG. 1 is crimped onto and over the tubular housing 12 at crimping groove 43. The location of crimping groove 43 on the housing 12 allows for a spaced apart relationship between aft end cap 24 and shell primer 19. The spaced so formed becomes the combustion chamber for the black powder charge 22.

Figure 3:
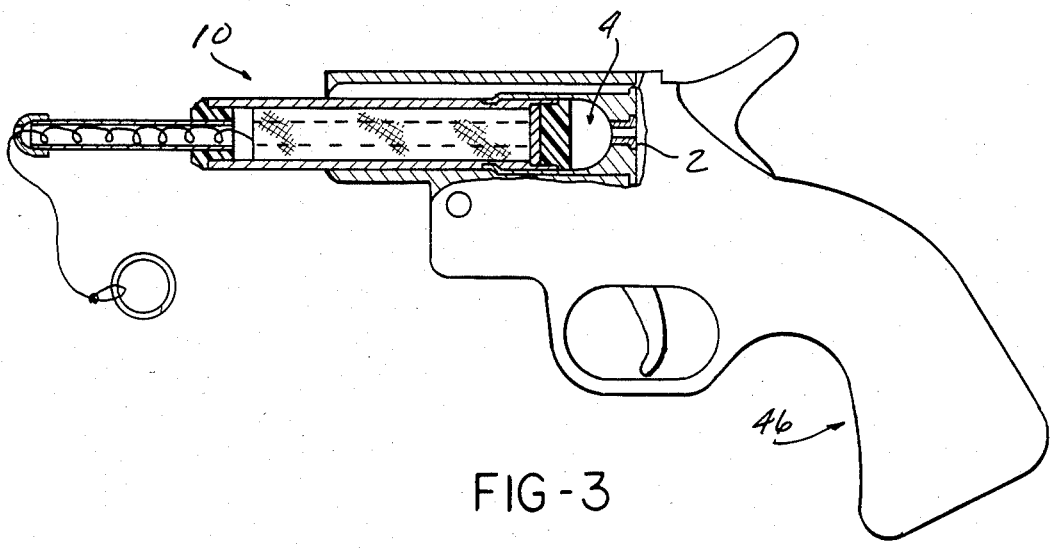
FIG. 3 shows a line launcher chamber into a typical marine flare pistol.

Referring now to FIG. 3, the drawing depicts a 12 gauge marine flare pistol 46 of conventional design with line launcher 10 chambered thereinto. The physical size and dimensions of this 12 gauge embodiment are smaller than the 25 millimeter embodiment shown in FIGS. 1 and 2. Also note that the combustion chamber 4 does not contain a charge of black powder. The energy for propulsion is achieved totally by the shell primer 2. This shell primer 2 is of different composition than the black powder shell primer 19 used in the 25 millimeter embodiments. This shell primer 2 is of the type and design commonly employed with smokeless powder fired projectile such as shot gun cartridges. The energy potential in the 12 gauge embodiment is, therefore, substantially less than the black powder propelled 25 millimeter type. Considerations of the amount of energy released and subsequent forces and stresses thereby applied for any commonly used marine flare pistol are imperative for the user's safety. Both the 12 gauge and 25 millimeter line launcher of this instant invention are considered to have less potential energy than many commonly used parachute flares designed specifically for marine pistol usage, and are, therefore, safer to use.

The operation of the line launcher will now be described with reference to FIG. 3. In order to use the line launcher 10, the attachment means 44 is secured to a heavier line. For marine usage, this line is, preferably, of a floatable polypropylene composition. The marine flare pistol 46 is then aimed at an angle of approximately 30° to 45° above the horizon in the direction of the target. The pistol 46 is then discharged. The discharge of the flare pistol 46 will launch the housing 12 containing the line spool 28 and line 29 over the intended target. Because line 29 is center wound, it will continuously and smoothly uncoil during the trajectory of the device. When the projectile reaches its points of impact, the target will be connected to the person shooting the pistol by uncoiled line 29. A person in the area of the target can now haul in on line 29, pulling the larger line with it. The shooter and the target person are now connected by a substantial line.

Figure 4:
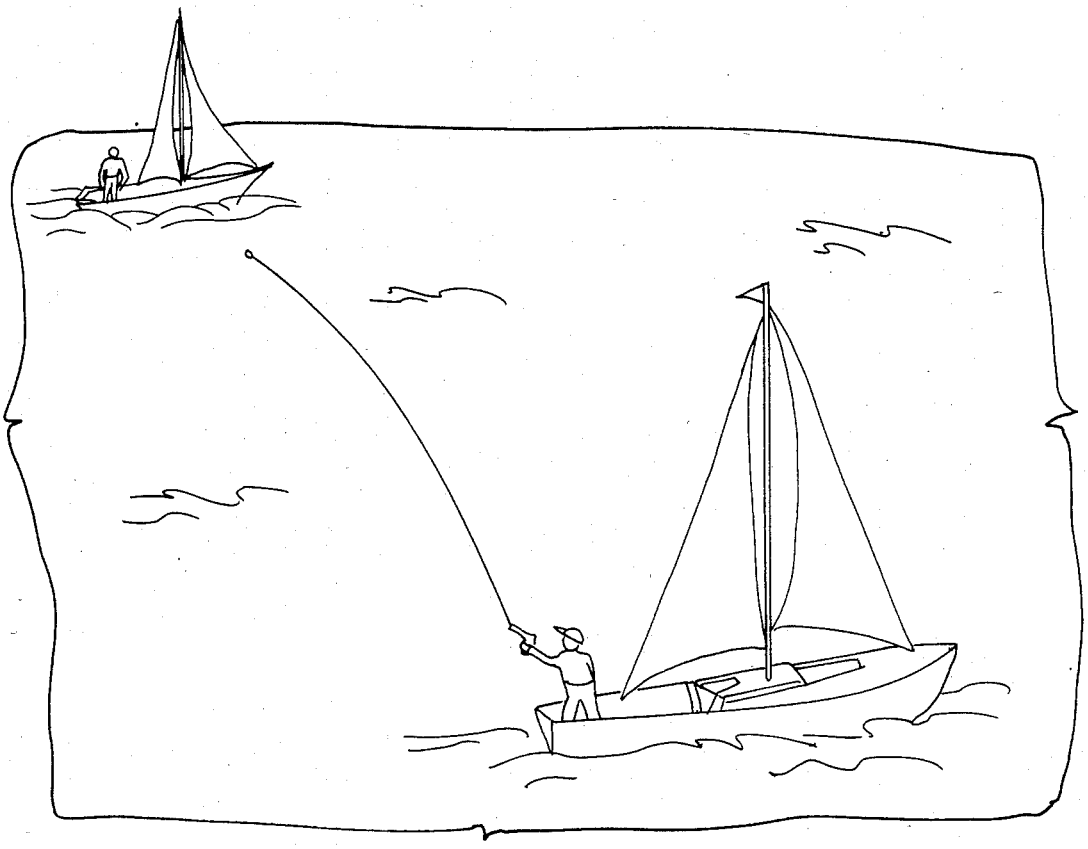
FIG. 4 illustrates the line launcher of the present invention in use in a typical marine situation.

The line launcher of the instant invention in use in a typical marine situation is illustrated in FIG. 4. As depicted therein, the person doing the shooting has aimed the marine flare pistol and disharged it. The projectile has been launched, and the line has continuously uncoiled from the line spool. When the projectile reaches its point of impact, the person in the target boat will be able to tow in the heavier, secondary line.

In summary, there has been disclosed a line launcher which launches a line spool provided with a length of lightweight line thereon toward a desired target. The line launcher is provided with a projectile propelling means, generally a blank cartridge which is chamberable into a marine flare pistol of conventional design. The line spool and the line are contained within a tubular housing mounted to the cartridge. The device also includes a ballasted aft end cap, an air space contained within the housing created by uncoiling of the line, and a fore end cap with a bore therethrough. One end of the line projects from the housing through the bore and may be secured to a heavier line. Upon launching the device by discharge of the pistol, the line continuously uncoils from the line spool until it reaches the point of impact. A secure line is then provided between the point of impact and the point of securing of the line.

I claim:

1. A line launcher for use in combination with a marine flare pistol, said line launcher comprising:

a tubular housing having fore and aft ends;

an aft end cap mounted on the aft end of the housing;

propelling means disposed behind the aft end of the housing, which is adapted to chamber into the marine flare pistol;

a line spool disposed within the housing, said spool being provided with a length of line wound thereon in such a manner as to permit ready coiling off therefrom, wherein the line has a free end;

a fore end cap mounted in the fore end of the housing and formed with a bore therethrough, said fore end cap including a portion of reduced diameter projecting from the housing, wherein the free end of the line is threaded through the bore and projects therefrom; and a fastening means attached to the free end of the line, wherein, when the housing is chambered into the marine flare pistol and the fastening means is secured, the pistol may be fired and the propelling means activated to cause the housing to be forcibly ejected from the pistol in the direction of fire thereof, the line spool uncoiling the line during its trajectory to provide a secure line between its point of impact and the point of attachment to the secondary line.

2. The line launcher of claim 1 wherein the propelling means comprises a cartridge containing a charge therein and an inpact ignited primer, said cartridge being sized appropriately to chamber into the marine flare pistol.

3. The line launcher of claim 1 further comprising an air chamber formed by a vacant space between the fore end cap of the housing and the aft end cap of the housing after the line spool has uncoiled to give the housing buoyancy in water.

4. The line launcher of claim 3 further comprising ballast means securely mounted on the aft end cap, whereby the ejected housing will float in a fore end up orientation and above the water line while in the water.

5. The line launcher of claim 3 further comprising means of lumination mounted on the reduced diameter projection of the fore end cap.

6. A line launcher for use with combination with a marine flare pistol, said line launcher comprising:

a tubular housing having watertight fore and aft ends;

an aft end cap mounted over the aft end of the housing;

a lead ballast mounted onto an interior face of the aft end cap;

a cartridge attached to the aft end of the housing and adapted to chamber into the marine flare pistol, said cartridge including a shell primer and containing an appropriate charge therein;

a line spool disposed within the housing, said spool being provided with a length of line wound thereon in such a manner as to permit ready uncoiling off therefrom, wherein the line has a free end;

a fore end cap mounted in the fore end of the housing and having a bore therethrough;

a hollow nose tubing mounted in the bore of the bore end cap and projecting therefrom;

a capsule capable of luminescence mounted on a side wall of the nose tubing;

a hollow, bored nose cap mounted over the projecting end of the nose tubing, wherein the free end of the line is sequentially threaded through the bore of the fore end cap, the nose tubing, and the bore of the nose cap so as to project from the line launcher;

a ring attached to the projecting free end of the line;

wherein, when the cartridge is chambered into the marine flare pistol and the ring is secured to a secondary line, upon discharge of the pistol, the housing will be forcibly ejected therefrom in the direction of fire thereof, the line spool uncoiling the line during its trajectory to provide a secure line between its point of impact and the point of attachment to the secondary line.

* * * * *